US006298510B1

(12) United States Patent
Mossbeck

(10) Patent No.: US 6,298,510 B1
(45) Date of Patent: Oct. 9, 2001

(54) ROLL PACKED BEDDING PRODUCTS

(75) Inventor: Niels S. Mossbeck, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/707,472

(22) Filed: Nov. 7, 2000

Related U.S. Application Data

(62) Division of application No. 09/397,337, filed on Sep. 15, 1999, now abandoned.

(51) Int. Cl.[7] ..... A47C 25/00; A47C 23/04

(52) U.S. Cl. ..... 5/655.7; 5/716; 29/91.1; 29/114; 29/118

(58) Field of Search ..... 5/655.7, 716, 654.1, 5/717, 721; 29/91.1, 91, 91.5, 91.6; 53/430, 383.1, 376.5, 118, 114

(56) References Cited

U.S. PATENT DOCUMENTS

| | | |
|---|---|---|
| 1,643,091 | 9/1927 | Rosenthal et al. . |
| 1,685,851 | 10/1928 | MacInerney . |
| 1,898,573 | 2/1933 | Schubert . |
| 2,114,008 | 4/1938 | Wunderlich . |
| 2,129,038 | 9/1938 | Schob . |
| 2,193,410 | 3/1940 | Schubert . |
| 2,247,543 | 7/1941 | Bernstein . |
| 3,111,690 | 11/1963 | Tarlow . |
| 3,200,418 | 8/1965 | Lebens . |
| 3,325,833 | 6/1967 | Withoff . |
| 3,576,040 | 4/1971 | Larsen . |
| 3,579,774 | 5/1971 | Shreve . |
| 3,813,843 | 6/1974 | Wooldridge et al. . |
| 4,194,255 | 3/1980 | Poppe . |
| 4,244,089 | 1/1981 | Cavaler . |
| 4,602,471 | 7/1986 | Gray et al. . |
| 4,669,247 | 6/1987 | Woffendin . |
| 4,711,067 | 12/1987 | Magni . |
| 4,995,162 | 2/1991 | Beteré Cabeza . |
| 5,432,964 | 7/1995 | Strell . |
| 5,438,718 | 8/1995 | Kelly et al. . |
| 5,761,784 | 6/1998 | Ogle et al. . |

*Primary Examiner*—Alexander Grosz
(74) *Attorney, Agent, or Firm*—Wood, Herron & Evans, L.L.P.

(57) ABSTRACT

A roll of roll-packed bedding products is created by permanently securing spaced spring units between first and second webs of insulator material. The bedding products are compressed and wound into a roll for shipping. During shipment and handling, the spring units are maintained within the roll in a similar orientation spaced from one another by the first and second webs of insulator material until the roll is unrolled and the insulator web material cut between the spring units to create spring units having the insulator web material thereon.

13 Claims, 3 Drawing Sheets

ROLL PACKED BEDDING PRODUCTS

CROSS-REFERENCE TO RELATED APPLICATIONS

This application is a divisional application of U.S. patent application Ser. No. 09/397,337 filed Sep. 15, 1999 now abandoned entitled METHOD OF PACKAGING SPRINGS AND RESULTING PACKAGED PRODUCT which is fully incorporated by reference herein.

FIELD OF THE INVENTION

This invention relates to the packaging of springs. More specifically, this invention relates to a method of roll-packing plural spring units.

BACKGROUND OF THE INVENTION

It is known in the art to pack spring units for use in making mattresses by winding a length of flexible web material, e.g., disposable paper or re-usable hessian around a mandrel and feeding the spring units successively into the nip between the growing roll and the traveling web material. The spring units are compressed as they are drawn into the roll, and the result is that the roll-packed springs have a much reduced volume as compared to conventionally stacked spring units.

One type of machine known for this purpose has a winding mandrel to which a holding bar is bolted by its ends for holding the leading end of a packing web material. An upwardly moveable pressure roller is mounted above the mandrel so as to define therewith an entry nip for the web material. The web material is fed from a reel supported at the rear of the machine over the pressure roller and on to the mandrel. An operator standing at the front of the machine feeds springs into the entry nip.

Another machine for packing bedding springs is seen in U.S. Pat. No. 4,669,247. The 247 patent describes packing spring units into a roll with a web of paper or other reusable material. A similar spring packing machine is seen in U.S. Pat. No. 2,114,008, in which a roll of wrapping paper is fed along a table and into a wrapping mechanism whereat spring assemblies are placed upon the paper and fed into the machine by the paper movement.

All of these prior art machines compress and wrap springs in a single web of paper or reusable material which separates the multiple layers of spring units in a roll and maintains the springs in a compressed state for shipment from a spring manufacturer to a mattress manufacturer. This conventional roll packing technique tends to be expensive. Either large amounts of paper that will be eventually disposed of are used to wrap springs at a cost to the spring manufacturer which is often passed on to the mattress manufacturer, or much more expensive recyclable packaging is used to roll and ship springs. The recyclable material which is used to roll and ship springs must be thereafter shipped back to the spring manufacturer who, again, may incur the cost of shipping back the material and may pass that expense on to the mattress manufacturer. In addition, recyclable spring packaging material has a relatively short life span, albeit longer than paper packaging.

Therefore, it has been one objective of the present invention to reduce the cost of packaging and shipment of spring units.

It has been another objective of the present invention to provide a method of packaging spring units without using conventional paper or reusable packaging methods.

It has been a further objective of the present invention to provide a method of packaging a spring unit in which the spring unit is packaged in insulator material that will not be disposed of but, rather, be used by the mattress manufacturer in mattress production.

SUMMARY OF THE INVENTION

The preferred embodiments of the present invention accomplish these objectives with a method of packaging a resilient spring unit such as a plurality of interconnected coil springs in which first and second webs of spring insulator material are first attached to the spring unit so as to be located against the spring unit top and bottom surfaces and thereafter roll-packed for shipment from a spring manufacturer to a mattress manufacturer who simply unrolls the spring units and cuts the insulator material between the spring units, the spring units having the insulator material attached thereto to be used in mattress manufacture so as to eliminate the need to roll-pack the spring units with disposable paper or expensive reusable material.

The spring unit has a uniform depth defined by a generally planar top first surface and a parallel generally planar bottom second surface. The spring unit has a longitudinal dimension or length defined by a pair of opposed parallel end surfaces and a transverse dimension or width defined by a pair of opposed parallel side surfaces. The longitudinal dimension or length is generally greater than the transverse dimension or width of the spring unit as in most bedding products. However, a square spring unit in which the longitudinal and transverse dimensions are equal may also be packaged using this inventive method.

The method of the present invention comprises providing first and second web rolls of insulator material spaced from one another. The first web roll comprises a first web of spring insulator material, e.g., woven or non-woven material, wound about a core. Similarly, the second web roll comprises a second web of spring insulator material wound about a core.

Each of the first and second webs of insulator material have a pair of opposed side edges defining a width of the web which is wider than the spring unit's transverse dimension. Each web across its width has a pair of opposed side portions and a central portion between the side portions.

The first web of insulator material is passed over and located against the first surface of the spring unit, and the second web is passed under and located against the second surface of the spring unit. The longitudinal dimension of the spring unit is generally parallel to the opposed side edges of the first and second webs which are generally parallel to one another.

In a first preferred embodiment, the first and second webs are folded back upon themselves around the top and bottom turns of the edgemost coil springs of the spring unit so that the opposed side portions are located against the surface of the central portion located against the spring unit. These side portions are then bonded, welded or otherwise secured to the central portion. In a second preferred embodiment, the side portions of the first web are bonded or welded to the adjacent side portions of the second web so as to form a tight fitting sleeve in which the spring unit is securely located. The spring unit with the first and second webs secured thereagainst constitutes a bedding product.

The final step in the method of the present invention is to draw the bedding product into a roll packing machine in which the bedding product is compressed and rolled onto a dowel whereafter the bedding product is maintained in this rolled and compressed state for shipment to a mattress manufacturer.

These and other objectives and advantages of this invention will be readily apparent from the following brief description of the drawings.

DETAILED DESCRIPTION OF THE PREFERRED EMBODIMENT

Figure 1:
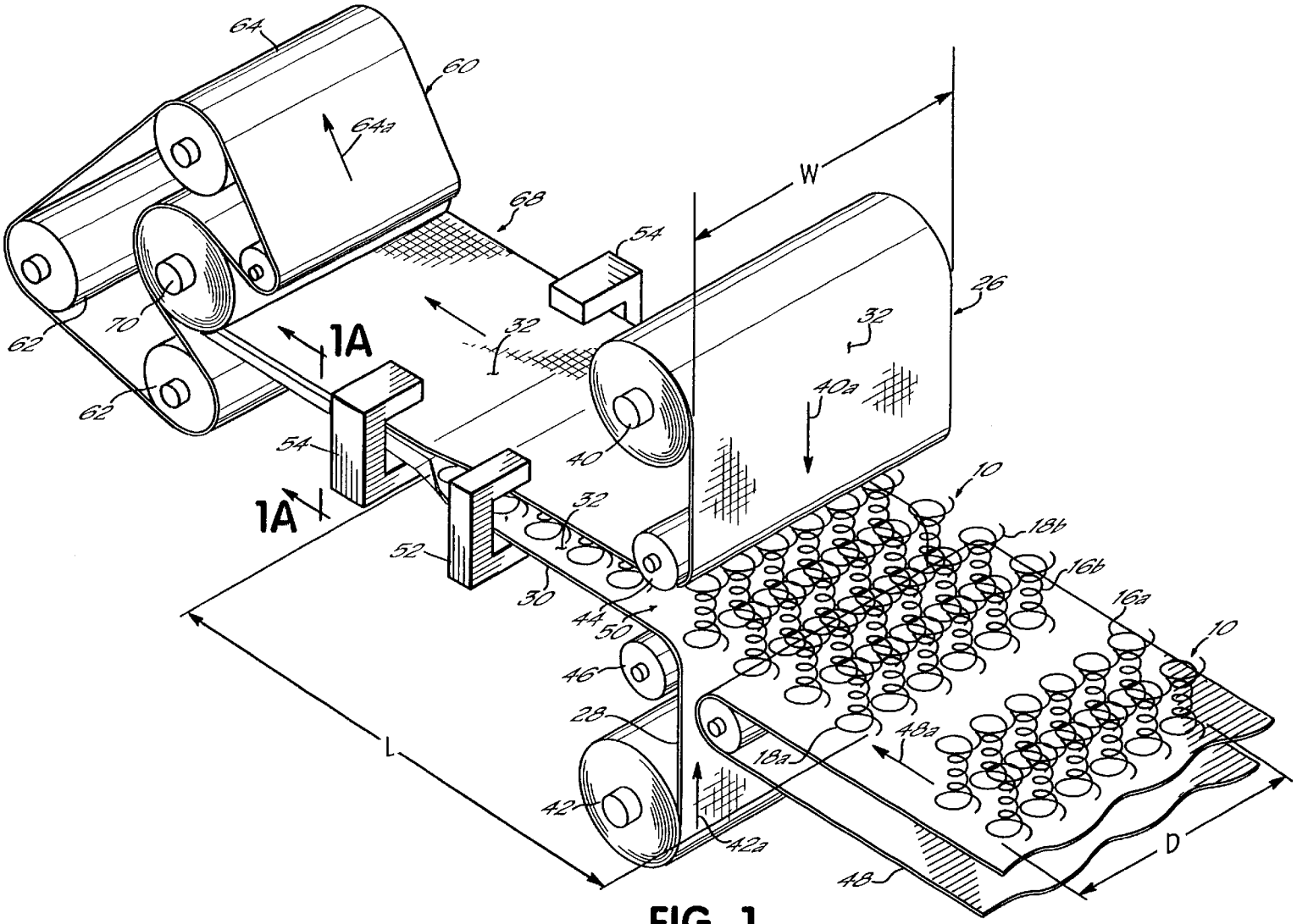
FIG. 1 is a perspective view of a first preferred embodiment of the present inventive method of packaging a resilient spring unit.

As can be seen generally in FIGS. 1, 1A, 3, 3A, a spring unit generally has a top or first surface 12 and a bottom or second surface 14. The spring unit 10 has a length or a longitudinal dimension L and a width or a transverse dimension D, the longitudinal dimension L being generally larger than the transverse dimension D. However, it will be appreciated by those in the art that L may be substantially similar to D in dimension. The spring unit 10 has a thickness T between the first surface 12 and the second surface 14 which defines opposing end surfaces 16*a*, 16*b* and opposing side surfaces 18*a*, 18*b*.

The spring unit 10 is generally comprised of a plurality of coil springs 20, the coil springs 20 being secured one to another by means generally known in the art. Each coil spring 20 has a top turn 22 comprising a portion of the first surface 12 and a bottom turn 24 comprising a portion of the second surface 14.

The first surface 12 and the second surface 14 are covered with first and second webs 26, 28, respectively, of insulator material. The insulator material used to cover the first and second surfaces 12, 14 of the spring unit 10 is generally a woven or non-woven material. Each of the first and second webs 26, 28 have an outer surface 30 and an inner surface 32, the inner surface 32 of each of the first and second webs 26, 28 being located against the first and second surfaces 12, 14 of the spring unit 10, respectively.

Figure 1A:
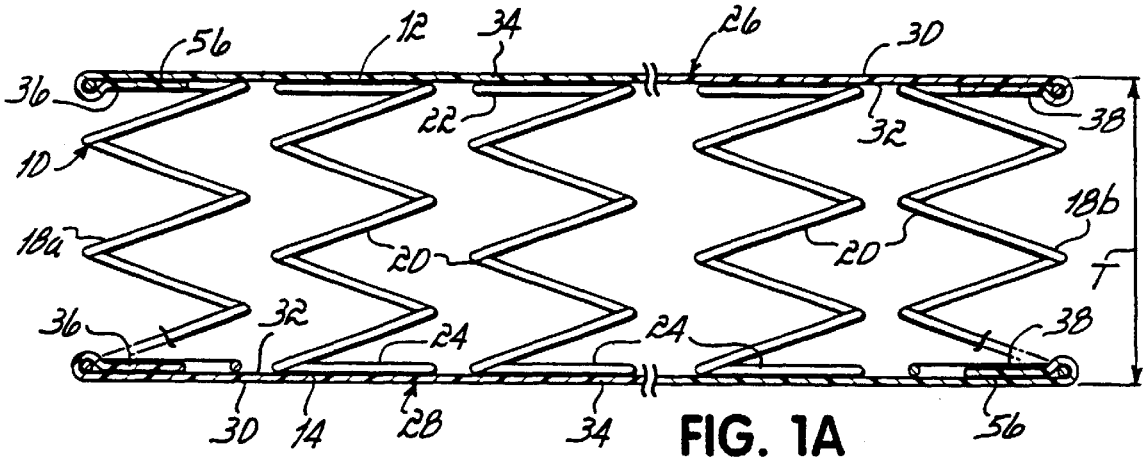
FIG. 1A is a cross-section of FIG. 1 taken along lines 1A—1A.
Figure 3A:
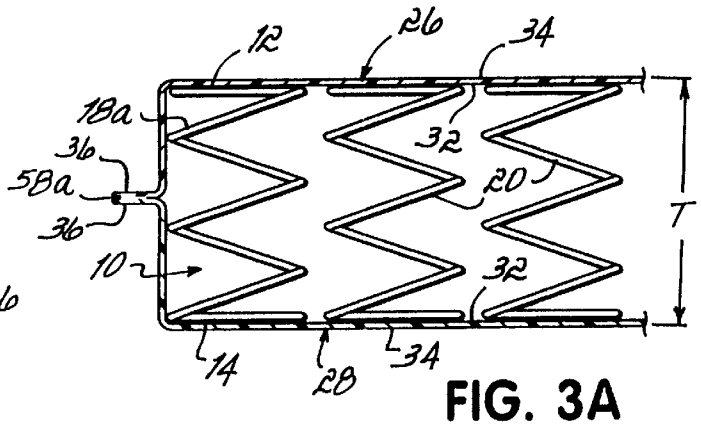
FIG. 3A is a cross-sectional view of FIG. 3 taken along lines 3A—3A.

As seen in FIGS. 1A and 3A, each of the first and second webs 26, 28 has a center portion 34 and opposed side portions 36, 38. Each of the first and second webs 26, 28 has a substantially similar width W larger than the transverse dimension D of the spring unit 10 so that the opposed side portions 36, 38 generally extend beyond the transverse dimension D of the spring unit 10 in substantially equal amounts. The lengths (not indicated) of the first and second webs 26, 28 are considerably longer than the longitudinal dimension L of a single spring unit 10 so that plural spring units 10 may be packaged by the inventive method described in further detail below.

In the present inventive method of packaging a spring unit 10, the first and second webs 26, 28 are carried upon respective first and second cores 40, 42 which allow the first and second webs 26, 28 to be drawn therefrom in reverse directions as indicated by directional arrows 40*a*, 42*a*. The first and second webs 26, 28 are drawn between respective first and second guide rollers 44, 46, the rollers 44, 46 being spaced apart from each other so that spring unit 10 may be received therebetween. A conveyor 48 transports the spring unit 10 by directional arrow 48*a* into a space 50 defined between the first and second rollers 44, 46 whereat the first and second webs 26, 28 are passed over and under and located against the first and second surfaces 12, 14, respectively, of the spring unit 10.

In a first preferred embodiment, after the first and second webs 26, 28 are located against the respective first and second surfaces 12, 14 of the spring unit 10, an adhesive unit 52 deposits adhesive 56 upon the inner surface 32 of the side portions 36, 38 of each of the first and second webs 26, 28. The spring unit 10 having the first and second webs 26, 28 located thereagainst is then passed to a folding unit 54 which folds the inner surface 32 of the side portions 36, 38 of each of the first and second webs 26, 28 with the adhesive 56 deposited thereon against the inner surface 32 of the respective center portion 34 and against the top and bottom turns 22, 24 of the coil springs 20 comprising the longitudinal margins of the spring unit 10.

Figure 3:
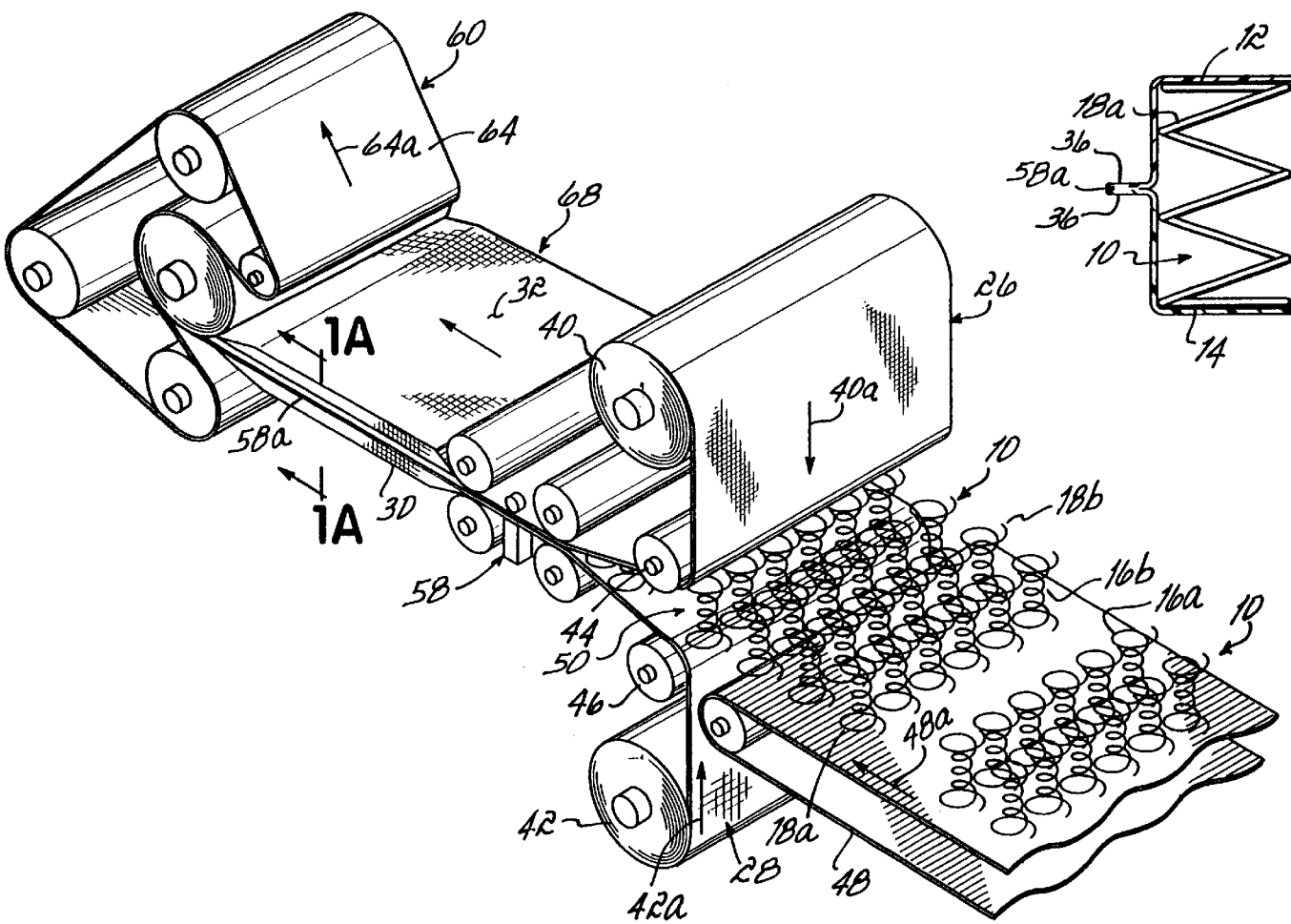
FIG. 3 is a perspective view of a second preferred embodiment of the present inventive method.

As seen in FIGS. 3 and 3A, in a second preferred embodiment, after the first and second webs 26, 28 are located against respective first and second surfaces 12, 14 of the spring unit 10, the spring unit 10 with the first and second webs 26, 28 located thereagainst is passed to a welding unit 58 whereat the reverse sides 32 of the opposed side portions 36 of the first web 26 are welded to the adjacent side portions 36 of the second web 28. While only side portions 36 of the first and second webs 26, 28 are shown in FIG. 3A, it will be understood that side portions 38 are a mirror image thereof and are welded in a similar manner. The welding together of the first and second webs 26, 28 may be accomplished by any suitable welding process for woven or non-woven materials known in the art, e.g., ultrasonic or radio frequency welding, to create a weld 58a, as seen in FIG. 3A.

Figure 2:
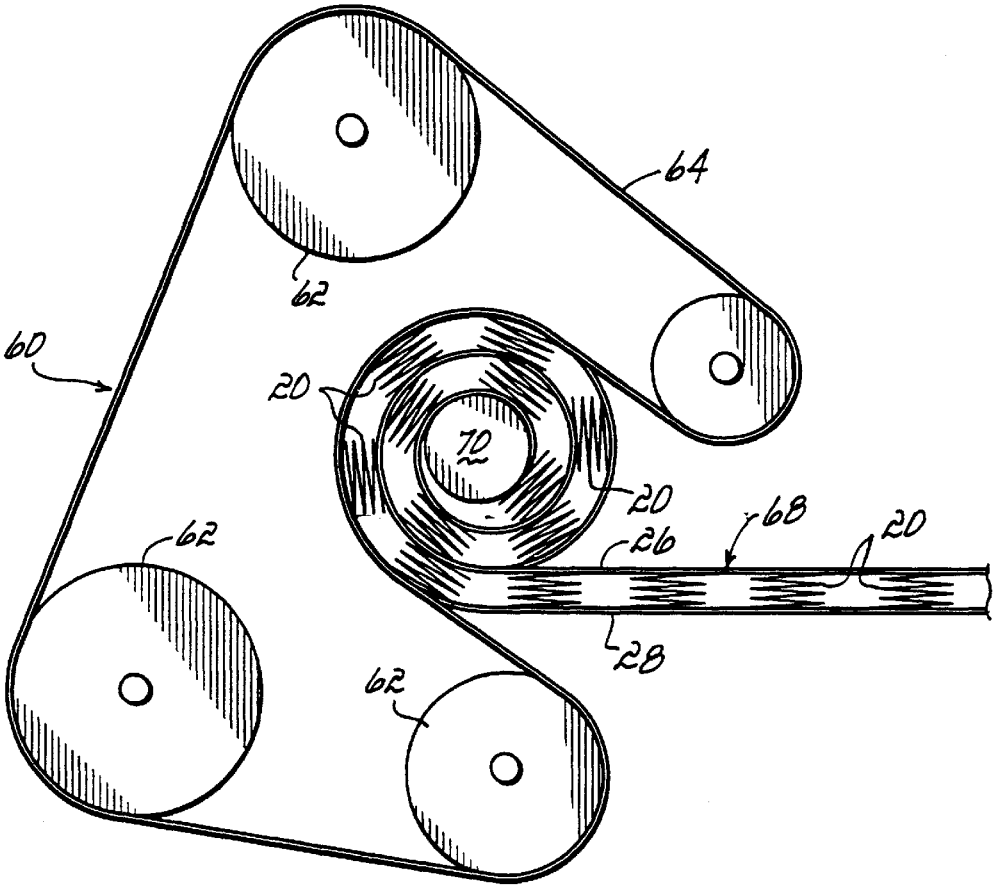
FIG. 2 is a side view of a bedding product being roll packed.

After the first and second webs 26, 28 have been fixedly located against the first and second surfaces 12, 14 of the spring unit 10 by either the gluing or the welding methods as described above, the spring unit 10 with the first and second webs 26, 28 located thereagainst is then passed to a roll packing machine 60 as best seen in FIG. 2. The roll packing machine 60 has a plurality of rollers 62 which carry thereon an endless belt 64 traveling in a direction indicated by directional arrow 64*a*. The spring unit 10 with the first and second webs 26, 28 attached permanently thereto comprises a bedding or seating product 68 ready for shipment, for example, from a spring manufacturer to a mattress or seat manufacturer. As the product 68 is wound about a core 70 upon which it is to be transported, the roll packing machine 60 compresses the bedding or seating product 68 so that plural bedding or seating products 68 may be so packaged.

When the packaged roll of bedding or seating units 68 arrive at the mattress or seat manufacturer's facility, all that the manufacturer need do is unroll the packaged products from the roll and transverse cut the webs 26, 28 at a location between the spaced spring units 10. The resulting bedding or seating product 68 having the insulator material permanently secured to its top and bottom sides is than ready for application of the appropriate padding and upholstery materials to complete the mattress or seat.

From the above disclosure of the detailed description of the present invention and the preceding summary of the preferred embodiment, those skilled in the art will comprehend the various modifications to which the present invention is susceptible. Therefore, I desire to be limited only by the scope of the following claims and equivalents thereof.

I claim:

1. A series of bedding products packed into a roll, said roll comprising:

a first spring unit having first and second surfaces, a longitudinal dimension and a transverse dimension, said first spring unit including a plurality of coil springs, each of said coil springs having a top turn and a bottom turn;

a first web of insulator material permanently secured to said first surface of said first spring unit to create a first bedding product;

a second web of insulator material permanently secured to said second surface of said first spring unit, a second spring unit spaced from said first spring unit, said second spring unit having opposed first and second surfaces to which said first and second webs of insulator material are permanently secured wherein said first and second webs of insulator material extend longitudinally between said spring units.

2. The series of bedding products of claim 1, wherein said first and second webs of insulator material are wrapped around said top and bottom turns of outermost springs of said spring units.

3. The series of bedding products of claim 1, wherein opposed side portions of said each of said webs of insulator material are bonded to a central portion of said web of insulator material.

4. The series of bedding products of claim 1, wherein opposed side portions of said first web of insulator material are folded around said top turns of select springs and bonded to an inner surface of said first web and opposed side portions of said second web of insulator material are folded around said bottom turns of said select springs and bonded to an inner surface of said second web.

5. A series of bedding products packed into a roll, said roll comprising:

a first spring unit comprising a plurality of coil springs, each of said coil springs having a top turn and a bottom turn, said first spring unit having first and second surfaces, a longitudinal dimension and a transverse dimension, a first web of insulator material having a pair of side portions and a center portion between said side portions, said center portion contacting said first surface of said first spring unit, a second web of insulator material having a pair of side portions and a center portion between said side portions, said center portion contacting said second surface of said first spring unit, a second spring unit spaced from said first spring unit, said second spring unit having opposed first and second surfaces contacted by said first and second webs of insulator material wherein said first and second webs of insulator material extend longitudinally between said spring units and said side portions of said first web of insulator material are secured to said side portions of said second web of insulator material.

6. A roll of roll-packed bedding products comprising:

a plurality of roll packed spring units, each spring unit comprising multiple springs and having generally parallel first and second surfaces; and first and second webs of insulator material extending longitudinally between said spring units, said spring units being permanently secured to said first and second webs of insulator material such that upon unrolling said bedding products, said spring units remain permanently secured to said first and second webs of insulator.

7. The roll of claim 6 wherein each of said webs of insulator material has an outer surface and an inner surface, said inner surface contacting one of said first and second surfaces of said spring unit.

8. A series of bedding products packed into a roll, said roll comprising:

a first spring unit comprising a plurality of springs, a second spring unit comprising a plurality of springs, said second spring unit being spaced from said first spring unit, at least one web of insulator material permanently secured to outermost springs of said spring units, wherein said at least one web of insulator material extends longitudinally between said spring units.

9. The series of bedding products of claim 8 wherein said at least one web of insulator material is wrapped around end turns of said outermost springs of said spring units.

10. A series of bedding products packed into a roll, said roll comprising:

a first spring unit comprising a plurality of springs defining opposed first and second surfaces, a second spring unit spaced from said first spring unit, said second spring unit comprising a plurality of springs defining opposed first and second surfaces, a first web of insulator material secured to outermost springs of said spring units, a second web of insulator material secured to outermost springs of said spring units, wherein said webs of insulator material extend longitudinally between said spring units.

11. The series of bedding products of claim 10 wherein upon unrolling said bedding products, said webs of insulator material remain secured to said spring units.

12. A series of bedding products packed into a roll, said roll comprising:

a first spring unit comprising a plurality of coil springs, each of said coil springs having a top turn and a bottom turn, said first spring unit having first and second surfaces, a second spring unit spaced from said first spring unit, said second spring unit comprising a plurality of coil springs, each of said coil springs having a top turn and a bottom turn, said second spring unit having first and second surfaces, first and second webs of insulator material, each of said webs of insulator material having a pair of side portions and a center portion between said side portions, said center portions of said webs contacting said surfaces of said spring units, wherein said first and second webs of insulator material extend longitudinally between said spring units and said side portions of said first web of insulator material are secured to said side portions of said second web of insulator material.

13. A series of bedding products packed into a roll, said roll comprising:

a first spring unit comprising a plurality of coil springs, each of said coil springs having a top turn and a bottom turn, said first spring unit having first and second surfaces, a second spring unit spaced from said first spring unit, said second spring unit comprising a plurality of coil springs, each of said coil springs having a top turn and a bottom turn, said second spring unit having first and second surfaces, first and second webs of insulator material, each of said webs of insulator material having a pair of side portions and a center portion between said side portions, said center portions of said webs contacting said surfaces of said spring units, wherein said webs of insulator material extend longitudinally between said spring units and said side portions of each of said webs of insulator material are wrapped around end turns of selected coil springs of said spring units and are secured to a respective center portion of said web of insulator material.

* * * * *

UNITED STATES PATENT AND TRADEMARK OFFICE

CERTIFICATE OF CORRECTION

PATENT NO. : 6,298,510 B1
DATED : October 9, 2001
INVENTOR(S) : Mossbeck

It is certified that error appears in the above-identified patent and that said Letters Patent is hereby corrected as shown below:

Title page,
Item [75], "Inventor…" insert -- Thomas J. Wells, Carthage, MO --

Column 1,
Line 6, the sentence should read -- ...Sep. 15, 1999, now… --
Line 37, the sentence should read -- The '247 patent... --

Column 3,
Line 24, "spring unit generally…" should read -- spring unit 10 generally --.

Column 5,
Lines 9 and 11, change "I desire", "I claim" to -- we desire, we claim --.

Signed and Sealed this

Sixth Day of August, 2002

*Attest:*

*Attesting Officer*

JAMES E. ROGAN
*Director of the United States Patent and Trademark Office*